US005775268A

United States Patent [19]

Ferguson

[11] Patent Number: 5,775,268

[45] Date of Patent: Jul. 7, 1998

[54] HIGH EFFICIENCY VERTICAL TUBE WATER HEATER APPARATUS

[75] Inventor: Mark A. Ferguson, Watauga, Tex.

[73] Assignee: PVI Industries, Inc., Fort Worth, Tex.

[21] Appl. No.: 637,224

[22] Filed: Apr. 24, 1996

[51] Int. Cl.[6] ..... F22B 5/00

[52] U.S. Cl. ..... 122/16; 122/14; 122/17

[58] Field of Search ..... 122/14, 16, 17

[56] References Cited

U.S. PATENT DOCUMENTS

| | | | |
|---|---|---|---|
| 4,271,789 | 6/1981 | Black | 122/16 |
| 4,530,347 | 7/1985 | Baker et al. | 122/31 R |
| 4,579,086 | 4/1986 | Maton | 122/17 |
| 5,197,415 | 3/1993 | Stretch et al. | 122/14 |
| 5,220,887 | 6/1993 | Hiddleston et al. | 122/17 |
| 5,437,249 | 8/1995 | Adams et al. | 122/17 |

FOREIGN PATENT DOCUMENTS

| | | | |
|---|---|---|---|
| 799679 | 8/1858 | United Kingdom | 122/17 |

*Primary Examiner*—Henry A. Bennett
*Assistant Examiner*—Gregory Wilson
*Attorney, Agent, or Firm*—Charles D. Gunter, Jr.; Grady K. Bergen

[57] ABSTRACT

A water heater apparatus is shown which includes a water heating tank having generally cylindrical sidewalls with upper and lower ends, each of which is closed by a transverse wall section to define a closed tank interior. The tank also has a water inlet and a water outlet. A plurality of vertically arranged fire tubes are connected between the upper and lower transverse wall sections, each fire tube having an open interior for conducting products of combustion. A combustion chamber is mounted on the upper end of the water heating tank for providing products of combustion to the open interiors of the fire tubes. A flue collector is located at the bottom end of the tank for collecting and exhausting the products of combustion from the vertically arranged fire tubes. An induction blower draws the products of combustion downwardly from the combustion chamber, through the fire tubes and out the flue collector for exhaustion from the apparatus. A specially designed burner operates at lower pressure conditions and provides a low capacity airflow to the unit when the main induction blower is off to create a static condition and prevent condensation within the internal components of the apparatus.

13 Claims, 2 Drawing Sheets

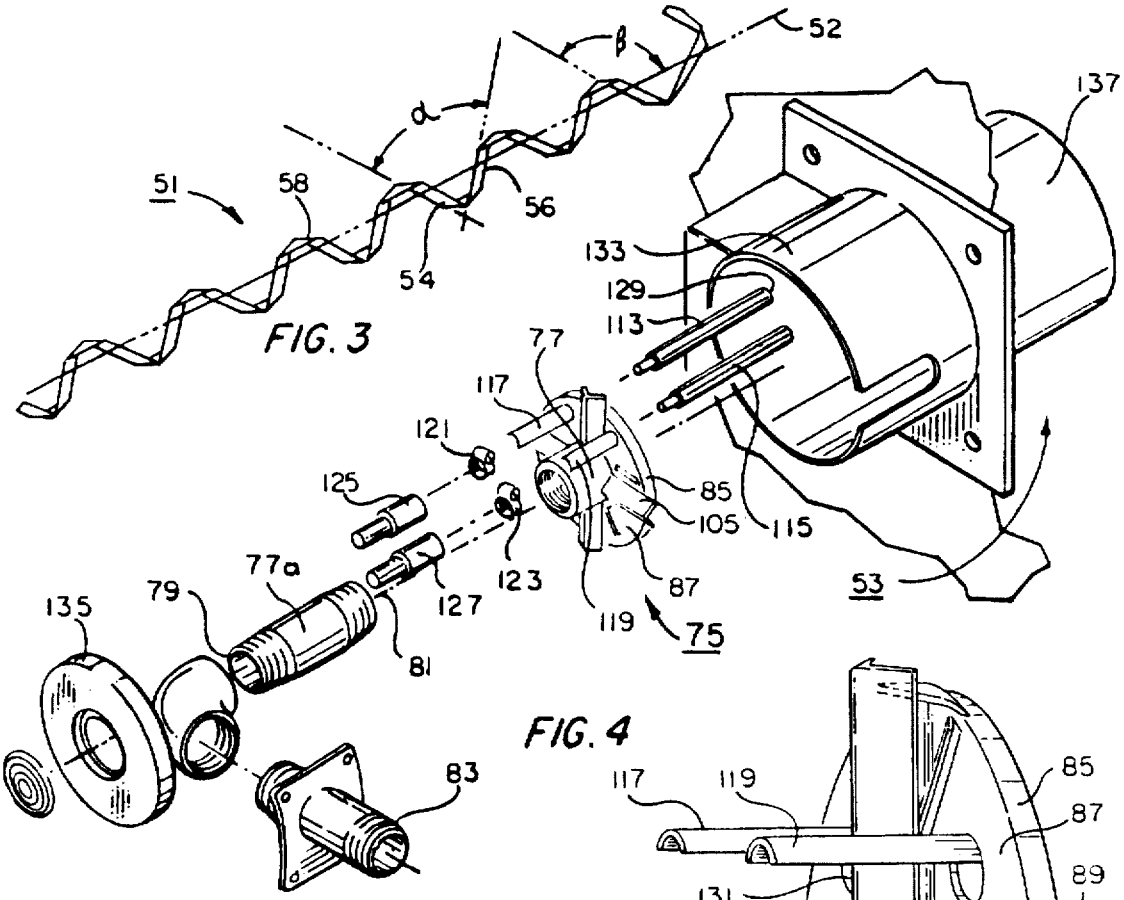
FIG. 3
FIG. 4
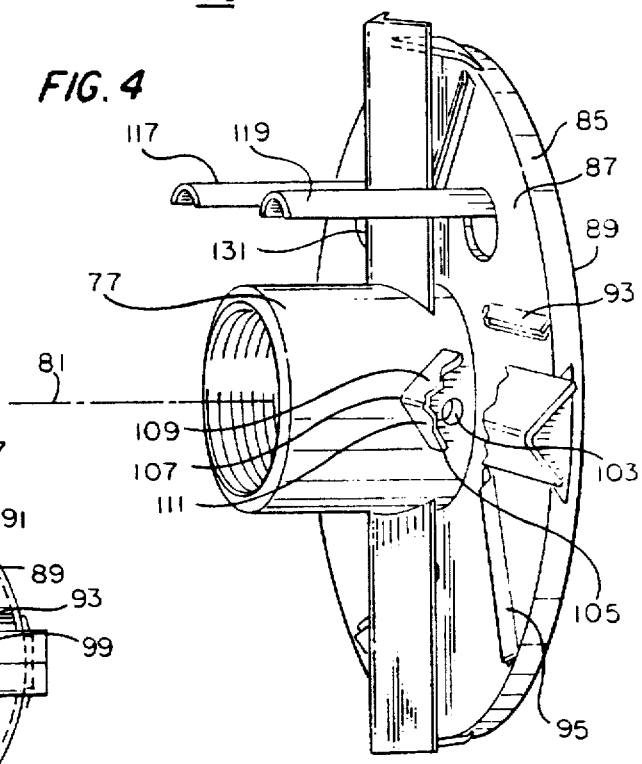
FIG. 5
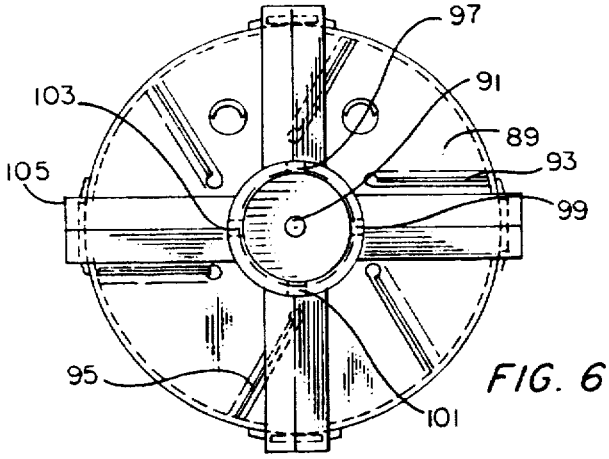
FIG. 6
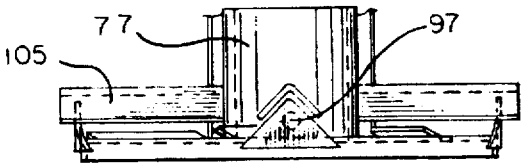
FIG. 6a

HIGH EFFICIENCY VERTICAL TUBE WATER HEATER APPARATUS

BACKGROUND OF THE INVENTION

1. Field of the Invention

The present invention relates generally to water heaters or boilers and, more specifically, to water heaters having a vertical tube tank and a combustion chamber for supplying heat to the closed tank interior.

2. Description of the Prior Art

Water heaters and boilers (referred to collectively as water heaters in the discussion which follows) typically have a water heater tank, often of the vertical tube type which utilizes fire tubes located above a combustion chamber. The typical prior art gas, oil or gas/oil fired water heaters featured a non-pressurized, external combustion chamber which was typically located on the bottom exterior of the water heater. Vertical shell or V-shell heat exchangers of the above type are well known in the industry.

Thus, for many years, typical water heater construction has provided for the flow of hot gas through a series of tubes mounted in vertical fashion between top and bottom transverse wall sections or support plates within the water heater tank. The products of combustion from the combustion chamber pass vertically upward through the open interiors of the vertical tubes and out a flue outlet. Water was circulated into and out of a chamber in the prior art devices located between the transverse wall sections. The water contacted and circulated about the exterior of the vertical tubes to effect heat transfer to heat the water.

If the combustion chamber could be mounted on the top of the vertical tube assembly, rather than on the bottom of such devices, the products of combustion could be passed downwardly through the vertical tubes in countercurrent fashion to the water being heated. This arrangement could actually result in increased efficiency, since the cold water typically enters a lower portion of the tank and the hot water typically exits an upper portion of the closed tank.

However, various problems have resulted in designs in which the combustion chamber is located at the top, rather than at the bottom exterior of the device. One problem is the production of condensate in the burner and other parts of the apparatus. The formation of condensate tends to cause corrosion and deteriorates the water heater internal components shortening the expected life of the device. Water stratification has also been a problem with the prior art designs which have featured combustion chambers at the top, rather than at the bottom. Whenever a countercurrent flow arrangement is utilized, colder water tends to sit at the bottom of the closed tank interior with hot water accumulating at the top. Steam also tends to be created at any "head" which might exist between the water level and top of the tank interior. If a temperature differential exists between the combustion chamber bottom wall and the tank top wall, steam creation is an even greater problem. Thus, prior art designs have tended to be complicated in design requiring extra insulation, corrosion protection, heavier duty metal construction, and the like.

A need exists for an improved vertical tube water heater apparatus having the combustion chamber at the top of the apparatus, rather than at the bottom.

A need also exists for such an apparatus which provides improved air movement within the device to prevent condensate from being formed within the internal components of the apparatus.

A need also exists for such a water heater having improved water circulation to prevent water stratification and the creation of steam within the closed tank interior.

A need also exists for an improved burner nozzle for use in the combustion chamber of such devices which is specifically designed for a vertical tube water heater having the combustion chamber on the top of the tube assembly and an induction fan on the bottom of the assembly.

A need also exists for an improved vertical tube water heater apparatus having vertical tube components which increase the overall efficiency of the apparatus in heating water.

A need exists for such an apparatus which is simple in design and relatively easy to manufacture.

SUMMARY OF THE INVENTION

The improved water heater apparatus of the invention includes a water heating tank having generally cylindrical sidewalls with upper and lower ends each of which is closed by an upper and lower transverse wall section, respectively, to define a closed interior for the tank. The tank has a water inlet and a water outlet.

A plurality of vertically arranged fire tubes are located within the tank closed interior. Each fire tube has an open interior for conducting products of combustion. A combustion chamber is mounted on the upper end of the water heating tank for providing products of combustion to the open interiors of the fire tubes. A burner communicates with the combustion chamber for combusting a selected fossil fuel, the burner having a burner inlet. A flue collector is located at the bottom end of the water heating tank for collecting and exhausting the products of combustion which are drawn downwardly through the interiors of the vertically arranged fire tubes. Draft means, such as an induction fan, are provided for drawing the products of combustion downwardly from the combustion chamber, through the fire tubes and out the flue collector for exhaustion from the apparatus. Recirculation means, such as a fluid recirculating pump, are provided for recirculating the water from a lower region of the tank closed interior to an upper region thereof when the tank closed interior is filled with water.

Preferably, a low capacity blower is located at the burner inlet for producing a static condition within the combustion chamber, fire tubes and flue collector when the induction blower is off. Each of the vertically arranged fire tubes is preferably provided with a free standing turbulator which increases the heat transfer coefficient of the fire tubes.

The preferred burner of the invention has an improved burner nozzle which is located within a nozzle housing. The burner nozzle includes a fuel supply tube for supplying fuel from a fuel source. The supply tube has an open interior and a central longitudinal axis. A pressure plate is arranged transversely to the open interior of the fuel supply tube at one extent thereof and forms a portion of one end wall of the burner nozzle housing. The pressure plate has an inner side and an outer side and has a centrally located orifice therein for allowing the passage of fuel from the supply tube to the outer side of the pressure plate.

The pressure plate also has a plurality of radially extending slits therein for allowing the passage of air flowing within the nozzle housing from the inner side to the outer side of the pressure plate. Ignition means are located on the pressure plate outer side for igniting fuel which passes through the pressure plate orifice and which mixes with air passing through the pressure plate slits.

The air-fuel mixture is further augmented by venturi means, located on the pressure plate inner side, which creates a further air-fuel mix, the air-fuel mix so created passing through the pressure plate slits from the inner side to the outer side thereof. The venturi effect is created by a plurality of radially arranged apertures on the fuel supply tube which extend generally transverse to the central longitudinal axis thereof. Each aperture is shielded from an incoming airflow by a V-shaped deflector element having an apex which faces the incoming airflow and a pair of obliquely extending legs. An incoming airflow passes over the apex and around the obliquely extending legs to create turbulent mixing of air with fuel being supplied to the apertures of the fuel supply tube on the inner side of the pressure plate. The turbulent air-fuel mixture is subsequently passed through the slits to the outer side of the pressure plate for ignition by the ignition means.

Additional objects, features and advantages will be apparent in the written description which follows.

BRIEF DESCRIPTION OF THE DRAWINGS

FIG. 3 is an isolated view of a turbulator used within the vertical tubes of the water heater apparatus of the invention;

FIG. 4 is a partial, exploded view of the burner nozzle and a portion of the combustion chamber of the water heater of the invention;

FIG. 5 is a side, isolated view of the pressure plate of the burner nozzle of the invention;

FIG. 6 is a front view of the pressure plate of FIG. 5; and

FIG. 6*a* is a top view of the pressure plate of FIG. 6.

DETAILED DESCRIPTION OF THE INVENTION

Figure 1:
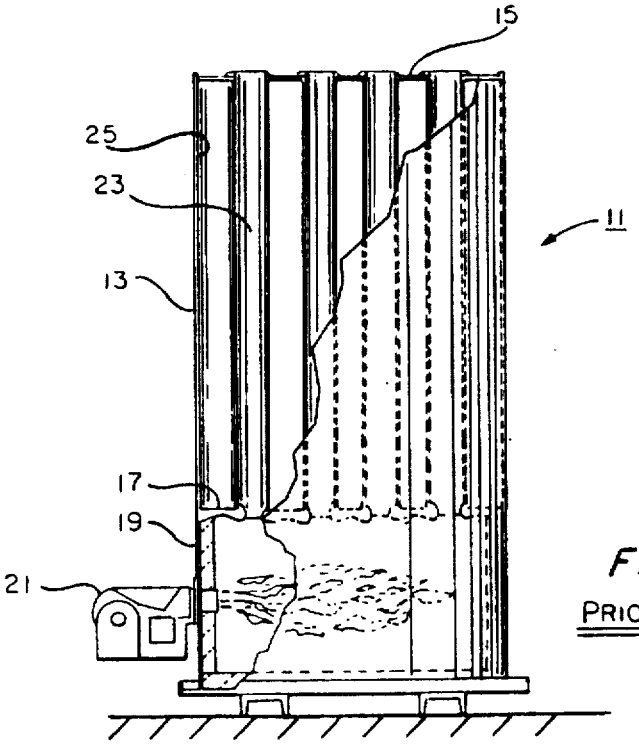
FIG. 1 PRIOR ART
FIG. 1 is a side, perspective view, partly broken away illustrating a vertical tube water heater of the prior art.

FIG. 1 shows a prior art vertical tube water heater apparatus, designated generally as 11. The water heater apparatus 11 includes a water heating tank 13 having generally cylindrical sidewalls with upper and lower transverse wall sections or support plates 15, 17. A combustion chamber or fire box 19 is located on the bottom of the apparatus and includes a power burner 21 for creating products of combustion within the fire box 19. The burner 21 could be, for example, a gas fired, "TURBO POWER" forced draft burner commercially available from PVI Industries, Inc., of Fort Worth, Tex.

A plurality of vertically arranged fire tubes 23 are located within a closed tank interior 25. Each fire tube 23 has an open interior for conducting products of combustion from the fire box 19 upwardly toward a flue collector (not shown) for exhausting the products of combustion from the device. Water is circulated within the tank interior 25 between a water inlet and a water outlet (not shown). The water contacts the exterior surfaces of the fire tubes 23 to effect heat transfer.

Figure 2:
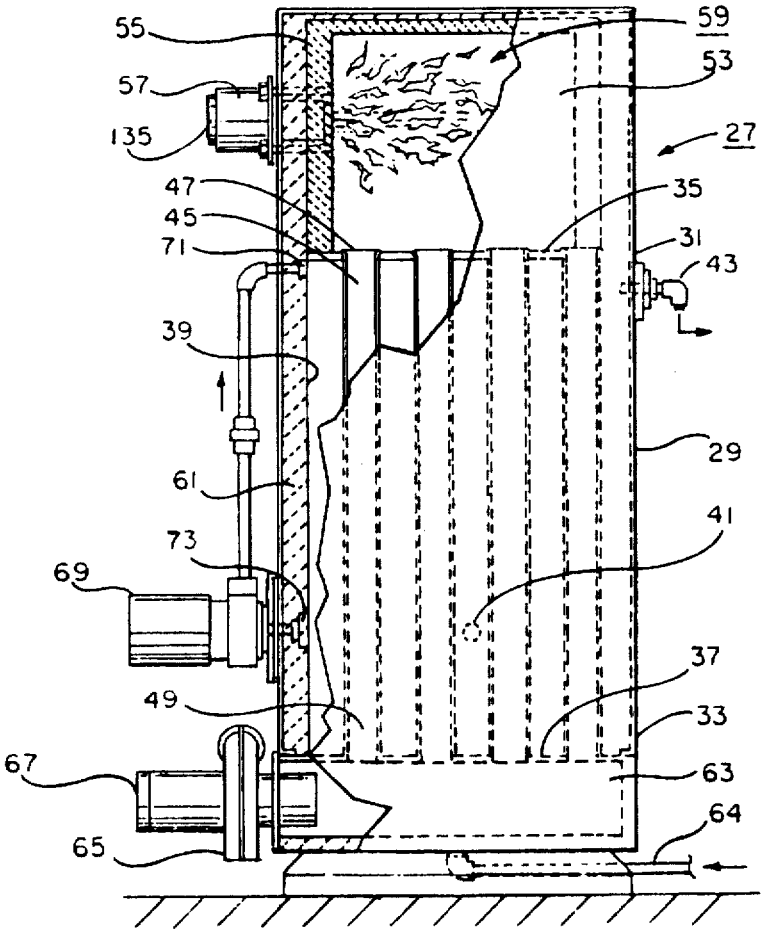
FIG. 2 is a view similar to FIG. 1 but showing the improved water heater apparatus of the invention.

FIG. 2 is a side, partial sectional view of the improved water heater apparatus of the invention, designated generally as 27. The water heater apparatus 27 includes a water heating tank 29 having generally cylindrical sidewalls with upper and lower ends 31, 33. Each of the initially open upper and lower ends 31, 33 is closed by an upper and lower transverse wall section 35, 37, respectively, to define a closed interior 39 for the tank. The tank 29 also has a water inlet (shown in dotted lines as 41 in FIG. 2) which admits water to the lower region of the tank interior and a water outlet 43 which allows water to flow out of the tank interior from the upper region thereof.

A plurality of vertically arranged fire tubes 45 are located within the tank closed interior 39. Each fire tube has an open interior and an upper end 47 and a lower end 49. There are typically thirty-six such fire tubes within the closed tank interior. The upper and lower tube ends 47, 49 are supported by means of the upper and lower transverse wall sections 35, 37, the tubes being welded within appropriate openings provided in the transverse wall sections.

As shown in FIG. 3, each vertical fire tube 45 has installed therein a free standing turbulator 51. The turbulator 51 is an internal heat exchange fin which is shaped as a twisted strip of metal which serves to provide turbulence in the combustion gases flowing through each fire tube and also to increase the heat exchange area between the combustion gas and the fire tube and thus through the wall of the fire tube to the surrounding water in the closed tank interior. Each turbulator 51 is formed as a series of angular breaks or bends which form compound angles with respect to the central longitudinal axis 52. The angle "β" in FIG. 3 diverges at approximately 60° from the central axis 52. The angle "α" between two adjacent sides 54, 56 is approximately 75°. Each adjacent side 54, 56 is connected by a bend or land 58 which forms a short, planar surface generally parallel to the longitudinal axis 52.

A combustion chamber 53 (FIG. 2) is mounted on the upper end 31 of the water heating tank 29 for providing products of combustion to the open interiors of the fire tubes 45. The combustion chamber 53 includes insulation 55 which can be, for example, of a suitable refractory material. A specially designed burner 57 is mounted on a sidewall of the combustion chamber 53 and communicates with the chamber interior 59 for supplying products of combustion thereto.

The tank 29 is also insulated by a suitable insulating material 61 and includes a flue collector 63 which is located at the bottom end 33 of the water heating tank for collecting and exhausting the products of combustion from the vertically arranged fire tubes 45. A condensate drain 64 can be used to remove any collected condensate from the flue collector 63. A draft inducing means, such as induction blower 65, driven by blower motor 67, pulls the products of combustion from the chamber interior 59 through the open interior of the vertical fire tubes 45 and through the flue collector 63 for exhaustion from the apparatus. The exhausted flue gases may be passed to the atmosphere or may be conveyed through an exhaust pipe to another location. Whereas the prior art designs having the combustion chamber on the bottom of the device tended to have much higher exhaust temperatures, e.g. up to 450° F., the exhaust gases of the present device remain generally below about 180° F., allowing the use of synthetic materials such as plastic pipe for the vent components, such as the vent duct.

In order to prevent the stratification of water within the closed tank interior 39, a recirculation means, such as recirculating pump 69 (FIG. 2) is provided for recirculating water from a lower region of the tank closed interior 39 to an upper region thereof when the tank interior is filled with water. Thus, water is drawn through the inlet 73 and is recirculated recirculating upwardly by the pump 69 to the outlet 71 located at a relatively higher region of the tank interior. Both the induction blower 65 and recirculating fluid pump 69 are of conventional design and are available from a number of commercial sources. Recirculation of the water within the closed tank interior further facilitates heat transfer and helps to prevent a steam "head" from developing below the combustion chamber bottom wall (35 in FIG. 2).

FIGS. 4–6*a* illustrate the improved burner assembly used with the water heater apparatus of the invention. The burner assembly, illustrated as 75 in FIG. 4, includes a fuel supply tube (77 and 77*a* in FIG. 4) for supplying a fuel from a fuel source. The fuel supply tube 77, 77*a* has an open interior 79 and a central longitudinal axis 81. The supply tube can be connected, for example, to a source of natural gas, or the like, through an appropriate gas inlet 83.

A pressure plate 85 (FIG. 5) is arranged transversely to the open interior 79 of the fuel supply tube 77 at one extent thereof and is generally transverse to the central longitudinal axis 81 of the supply tube. The plate has an inner side 87 and an outer side 89 and has a centrally located orifice 91 therein for allowing the passage of gas from the supply tube 77 to the outer side 89 of the pressure plate 85. The pressure plate also has a plurality of radially extending slits 93, 95 therein for allowing the passage of air from the inner side 87 to the outer side 89 of the plate 85.

The portion of the fuel supply tube 77 which terminates at the pressure plate 85 has a plurality of radially arranged apertures 97, 99, 101, 103 (FIG. 6) which extend generally transverse to the central longitudinal axis 81 thereof. Each aperture 97, 99, 101, 103 is shielded from an incoming airflow by a V-shaped deflector 105. Each V-shaped deflector element has an apex 107 (FIG. 5) which faces the incoming airflow and a pair of obliquely extending legs 109, 111, whereby an incoming airflow passes over the apex 107 and around the obliquely extending legs 109, 111 to create turbulent mixing of air with fuel being supplied to the apertures 97, 99, 101, 103 of the fuel supply tube 77 on the inner side 87 of the pressure plate 85. The turbulent air-fuel mixture is subsequently passed through the slits 93 to the outer side 89 of the pressure plate 85.

An ignition means is located on the pressure plate outer side 89 for igniting fuel which passes through the pressure plate orifice 91 and the air-fuel mixture which passes through the slits 93.

The ignition means can conveniently comprise a pair of electrodes 113, 115 (FIG. 4) which are connected to conventional circuitry for producing a timed spark on the downstream side of the pressure plate 85 for igniting the fuel and air mixture to produce products of combustion within the combustion chamber. In the apparatus illustrated in FIG. 4, the electrodes 113, 115 rest against guides 117, 119 affixed to the nozzle plate where they are secured by means of clamps 121, 123 to electrode boots 125, 127. At least one electrode includes an exposed tip 129 which extends through an appropriate opening 131 provided in the pressure plate. The electrodes themselves and the accompanying electrical circuitry used to provide a timed spark are conventional in the industry and will be familiar to those skilled in the art.

The burner assembly, as described, is received within a nozzle housing (133 in FIG. 4). The pressure plate 85 defines one closed end of the nozzle housing. The nozzle housing also has another closed end which in this case is provided by the pancake fan 135 (FIG. 4). The two closed ends of the nozzle housing 133 define an air passageway therebetween. A blast tube 137, comprising a generally cylindrical member with an open interior, extends outwardly from the outer side 89 of the pressure plate 85 within the combustion chamber 53.

The pancake fan 135 constitutes a low capacity blower located at the end of the nozzle housing 133 opposite the pressure plate 85 for producing a static condition within the combustion chamber, fire tubes and flue collector when the main, induction blower (65 in FIG. 2) is in the "off" condition. By providing a small capacity airflow to the unit when the induction fan 65 is off, enough airflow occurs to create a static condition within the internal components of the water heater assembly, thereby preventing the formation of condensate within the internal components. The use of the pancake fan 135 at the air inlet to the burner also helps to control "standby heat loss"; that is, heat loss from a water heater that is not water related. Most such loss is due to buoyant gases existing the flue. By establishing a static condition, standby heat loss is reduced. The pancake pan 135, is commercially available from a number of sources and is typically used, for example in personal computers to provide cooling. In the embodiment shown, the fan capacity for the pancake fan 135 is 5 cfm (cubic feet per minute) versus 120 cfm for the main induction fan 65.

In operation, a timed spark is provided to the burner 57 to produce combustion of fossil fuel, such as natural gas, within the combustion chamber 53. The products of combustion are drawn downwardly through the vertical tubes 45 to the flue collector 63 by the induction blower 65, where they are exhausted from the apparatus. Cold water enters the inlet 41 and is gradually warmed by transverse heat transfer with the fire tubes 45 and may be stored within the tank or may flow out the water outlet 43, as demand requires. In order to prevent stratification of the water within the tank interior, the recirculating pump 69 circulates water from the lower region adjacent the lower end 33 to the upper region of the tank adjacent the upper end 35. The recirculation of water provides more even heat exchange within the tank, increases heat transfer efficiency, and also prevents the formation of steam or a steam head adjacent the transverse wall section 35 beneath the combustion chamber 53.

An invention has been provided with several advantages. The water heater apparatus of the invention includes a vertical fire tube assembly with a combustion chamber located on the top of the assembly, rather than the bottom, for increased heat transfer efficiency. The novel burner and fan arrangement produces more efficient heating than was possible in the prior art designs and helps to eliminate the formation of condensate within the internal components of the apparatus. The special water recirculation feature of the apparatus prevents water stratification and the formation of a steam head within the unit. The special burner design works under lower pressure than the forced draft burners of the prior art. The countercurrent flow of the exhaust gases and water produces lower exhaust gas temperatures, generally below about 180° F. Lower temperature exhaust gas allows the use of PVC and other synthetic materials for vent conduits and piping. The novel burner design allows the use of a direct air input, rather than surrounding atmospheric air, if desired. By pairing a relatively lower capacity fan at the burner air inlet with a relatively higher capacity induction blower, a "static" condition can be produced within the device when the induction blower is in the off state, thereby reducing standby heat loss from the unit. The use of free standing turbulators in the fire tubes simplifies manufacture and provides increased heat transfer as well as more turbulent mixing of the combustion gases.

While the invention has been shown in only one of its forms, it is not thus limited but is susceptible to various changes and modifications without departing from the spirit thereof.

What is claimed is:

1. An improved water heater apparatus, comprising:

a water heating tank having generally cylindrical sidewalls with upper and lower ends, each of which is closed by an upper and lower transverse wall section, respectively, to define a closed interior for the tank, the tank also having a water inlet and a water outlet;

a plurality of vertically arranged fire tubes located within the tank closed interior, each fire tube having an open interior for conducting products of combustion, the exterior surfaces of the tubes being exposed within the interior of the tank for contact with water circulated within the tank interior;

a combustion chamber mounted on the upper end of the water heating tank for providing products of combustion to the open interiors of the fire tubes;

a burner communicating with the combustion chamber for combusting a selected fossil fuel, the burner having a burner inlet;

a flue collector located at the bottom end of the water heating tank for collecting and exhausting the products of combustion from the vertically arranged fire tubes;

draft inducing means for drawing the products of combustion downwardly from the combustion chamber, through the fire tubes and out the flue collector for exhaustion from the apparatus; and recirculating means for recirculating water from one region of the tank closed interior to an opposite region thereof when the tank closed interior is filled with water.

2. The water heater apparatus of claim 1, wherein the draft inducing means is an induction blower mounted on the exterior of the apparatus and communicating with the flue collector.

3. The water heater apparatus of claim 1, further comprising:

a free standing turbulator located within at least selected ones of the open interiors of the vertically arranged fire tubes.

4. An improved water heater apparatus, comprising:

a water heating tank having generally cylindrical sidewalls with upper and lower ends, each of which is closed by an upper and lower transverse wall section, respectively, to define a closed interior for the tank, the tank also having a water inlet and a water outlet;

a plurality of vertically arranged fire tubes located within the tank closed interior, each fire tube having an open interior for conducting products of combustion;

a combustion chamber mounted on the upper end of the water heating tank for providing products of combustion to the open interiors of the fire tubes;

a burner communicating with the combustion chamber for combusting a selected fossil fuel, the burner having a burner inlet;

a flue collector located at the bottom end of the water heating tank for collecting and exhausting the products of combustion from the vertically arranged fire tubes;

draft inducing means for drawing the products of combustion downwardly from the combustion chamber, through the fire tubes and out the flue collector for exhaustion from the apparatus; and recirculation means for recirculating water from one region of the tank closed interior to an opposite region thereof when the tank closed interior is filled with water; and wherein the draft inducing means is an induction blower mounted on the exterior of the apparatus and communicating with the flue collector; and the recirculation means is a recirculating pump located on the exterior of the apparatus and communicating with the tank closed interior by means of a water inlet, a water outlet and a conduit connecting the water inlet, pump and water outlet.

5. The water heater apparatus of claim 3, further comprising a low capacity blower located at the burner inlet for producing a static condition within the combustion chamber, fire tubes and flue collector when the induction blower is off.

6. The water heater apparatus of claim 5, wherein the low capacity blower is a pancake fan.

7. An improved water heater apparatus, comprising:

a water heating tank having generally cylindrical sidewalls which define a tank interior and upper and lower ends, the tank also having a water inlet and a water outlet;

a combustion chamber mounted on the upper end of the water heating tank;

a burner in the combustion chamber for combusting a selected fossil fuel, the burner having an air inlet;

a fire tube unit received within the tank interior, the fire tube unit comprising a plurality of vertically arranged fire tubes, each fire tube having an open interior and being interconnected by means of an upper and lower transverse wall section, the open interiors of the fire tubes being adapted to receive the products of combustion from the combustion chamber when the combustion chamber is connected to the water heating tank, the upper and lower transverse wall sections defining a closed tank interior for the water heating tank when the fire tube unit is installed within the tank interior;

a flue collector located at the bottom end of the water heating tank for collecting and exhausting the products of combustion from the vertically arranged fire tubes;

an induction blower communicating with the flue collector for drawing the products of combustion downwardly from the combustion chamber, through the fire tubes and out the flue collector for exhaustion from the apparatus; and a recirculating pump for recirculating water from a lower region of the tank closed interior to an upper region thereof when the tank closed interior is filled with water.

8. The water heater apparatus of claim 7, further comprising a low capacity blower located at the burner inlet for producing a static condition within the combustion chamber, fire tubes and flue collector when the induction blower is off.

9. The water heater apparatus of claim 8, wherein the low capacity blower is a pancake fan.

10. An improved water heater apparatus, comprising:

a water heating tank having generally cylindrical sidewalls with upper and lower ends each of which is closed by an upper and lower transverse wall section, respectively, to define a closed interior for the tank, the tank having a water inlet and a water outlet;

a plurality of vertically arranged fire tubes located within the tank closed interior, each fire tube having an open interior for conducting products of combustion;

a combustion chamber mounted on the upper end of the water heating tank for providing products of combustion to the open interiors of the fire tubes;

a burner assembly mounted on the combustion chamber for combusting a selected fossil fuel, the burner assembly having a burner nozzle housing with a burner air inlet;

a flue collector located at the bottom end of the water heating tank for collecting and exhausting the products of combustion from the vertically arranged fire tubes;

an induction blower for drawing the products of combustion downwardly from the combustion chamber, through the fire tubes and out the flue collector for exhaustion from the apparatus;

a recirculating pump for recirculating water from a lower region of the tank closed interior to an upper region thereof when the tank closed interior is filled with water;

wherein the burner assembly includes a fuel supply tube for supplying fuel from a fuel source, the supply tube having an open interior and a central longitudinal axis which is aligned generally with a central longitudinal axis of the burner housing;

a pressure plate arranged transversely to the open interior of the fuel supply tube at one extent thereof, thereby defining one closed end of the nozzle housing, the nozzle housing also having another closed end which defines an air passageway therebetween, the pressure plate having an inner side and an outer side and having a centrally located orifice therein for allowing the passage of fuel from the supply tube to the outer side of the pressure plate, the pressure plate also having a plurality of radially extending slits therein for allowing the passage of air from the air passageway on the inner side to the outer side of the plate;

ignition means located within a blast tube on the pressure plate outer side for igniting fuel which passes through the pressure plate orifice and mixes with air passing through the pressure plate slits; and venturi means located on the pressure plate inner side for creating a further air-fuel mix, the air-fuel mix so created passing through the pressure plate slits from the inner side to the outer side thereof.

11. The water heater apparatus of claim 10, wherein the fuel supply tube has a plurality of radially arranged apertures which extend generally transverse to the central longitudinal axis thereof, each aperture being shielded from an incoming airflow by a V-shaped deflector element having an apex which faces the incoming airflow and having a pair of obliquely extending legs, whereby an incoming airflow passes over the apex and around the obliquely extending legs to create turbulent mixing of air with fuel being supplied to the apertures of the fuel supply tube on the inner side of the pressure plate, the turbulent air-fuel mixture being subsequently passed through the slits to the outer side of the pressure plate for ignition by the ignition means.

12. The water heater apparatus of claim 11, further comprising:

a low capacity blower located at the end of the nozzle housing opposite the pressure plate for producing a static condition within the combustion chamber, fire tubes and flue collector when the induction blower is off.

13. The water heater apparatus of claim 12, wherein the low capacity blower is a pancake fan.

* * * * *